United States Patent [19]

Nagao et al.

[11] Patent Number: 4,767,070

[45] Date of Patent: Aug. 30, 1988

[54] GRINDER FOR USE IN GRINDING APPARATUS

[75] Inventors: Masamichi Nagao, 87-302 Ikidanchi Nishi-ku, Fukuoka; Masaaki Nagao, Nikko Nakadai-ryo A-1020, 3-1 Nakadai, Narita-shi, Chiba, both of Japan

[73] Assignees: Masamichi Nagao, Japan; Masaaki Nagao, Japan; Hitachi Techno Engineering Co. Ltd., Japan

[21] Appl. No.: 871,311

[22] Filed: Jun. 6, 1986

[30] Foreign Application Priority Data

Dec. 28, 1985 [JP] Japan ..... 60-298609
Apr. 9, 1986 [JP] Japan ..... 61-79982

[51] Int. Cl.[4] ..... B02C 7/08; B02C 7/12

[52] U.S. Cl. ..... 241/261.2; 241/260; 241/285 R; 241/296

[58] Field of Search ..... 241/250, 251 R, 258, 241/259, 259.1, 260, 261.2, 296, 285 R; 51/206 NF, 206 R, 207, 209 R

[56] References Cited

U.S. PATENT DOCUMENTS 2,120,697 6/1938 Finnegan ..... 241/260 X
3,746,266 7/1973 Knox et al. ..... 241/296 X
4,597,536 7/1986 Tloczynski et al. ..... 241/261.2 X

OTHER PUBLICATIONS

Doyle, "Manufacturing Processes and Materials for Engineers", Prentice-Hall, Inc., pp. 637-638.

*Primary Examiner*—Timothy V. Eley
*Attorney, Agent, or Firm*—Steinberg & Raskin

[57] ABSTRACT

A grinder for use in a grinding apparatus, comprising a pair of rotary and stationary discs facing each other, in which the rotary disc is rotated through a shaft by a drive motor, and in which a large number of grinding material particles are embedded in the surface of the discs to form microbites to grinding surfaces of the discs, and the strength of the grinding surface of the stationary disc is inferior to that of the rotary disc. The grinding is accomplished by fine cutting which is carried out by microbits formed of superhard grinding material particles having a sharp edge, rather than by mashing or abrasion. The grinder is formed as a cassette type so as to be replaced readily and quickly by new one. The grinder is provided with a clearance adjustor for adjusting the clearance between the rotary disc and the stationary disc.

12 Claims, 19 Drawing Sheets

FIG. 1
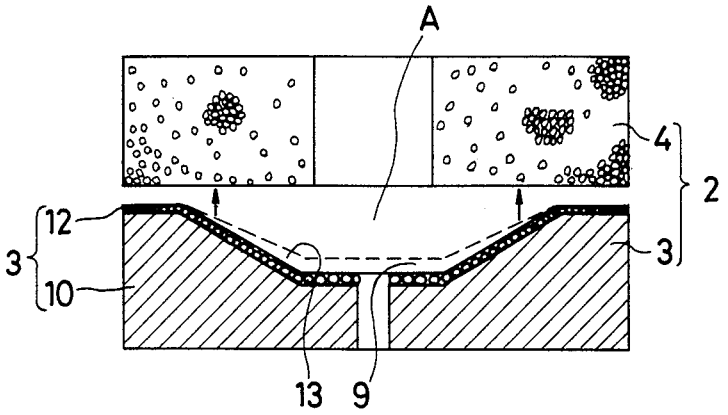
FIG. 2a
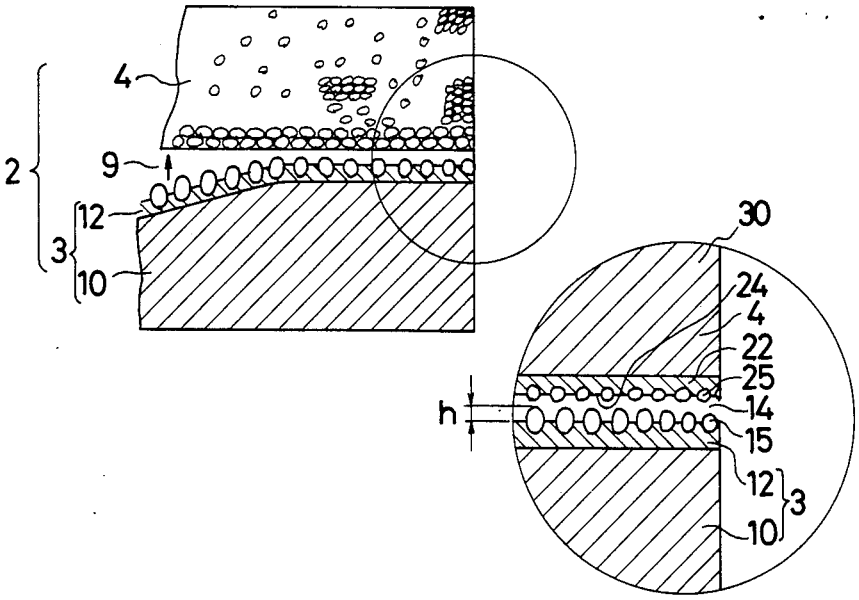
FIG. 2b

FIG.6A FIG.6B
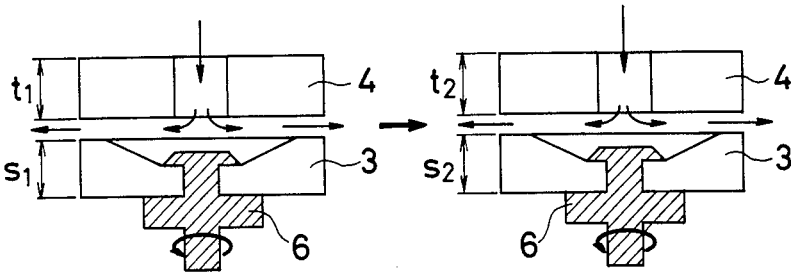
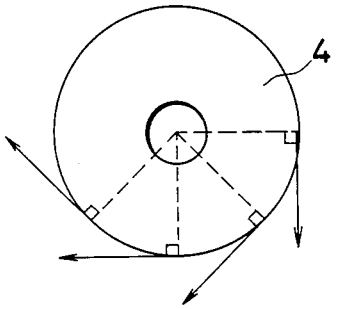
FIG. 6A'

FIG. 8a
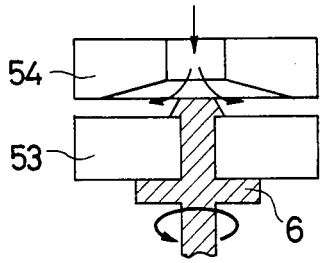
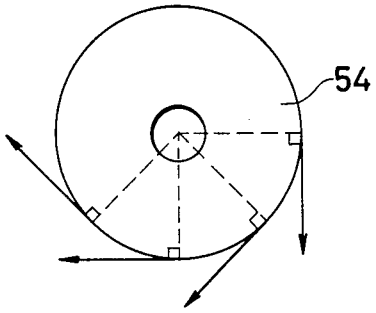
FIG. 8b
FIG. 9
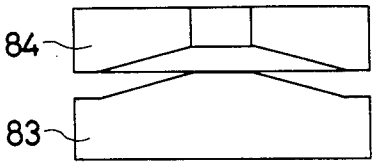
FIG. 10
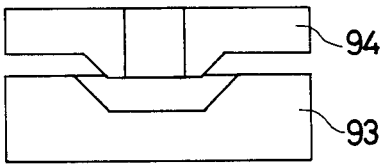

FIG.11A
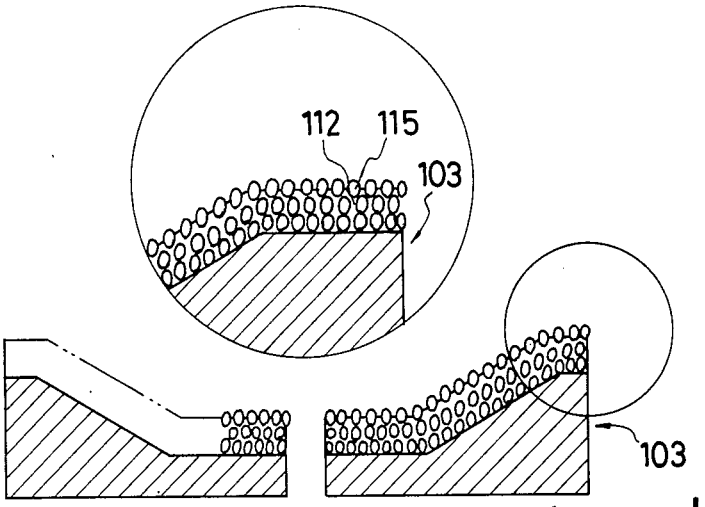
FIG.11A'
FIG.11B
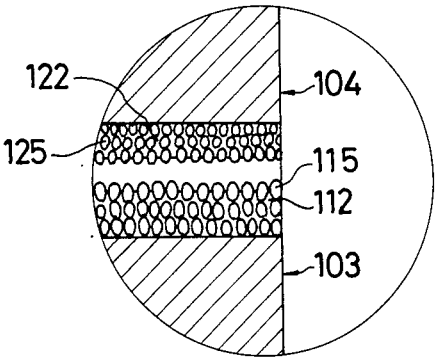

GRINDER FOR USE IN GRINDING APPARATUS

BACKGROUND OF THE INVENTION

The present invention relates to a grinder for use in a grinding apparatus which grinds foods, organic materials, minerals, or the like, into fine particles several to more than ten microns, in which a pair of grinding discs possess different strengths.

In a conventional grinder of a grinding apparatus, rotary and stationary discs are composed of the same whetstone having a low hardness. However, in this case, the rotary disc is worn away several times quicker than the stationary disc. Hence, the balance between the wearing speeds of the rotary and the stationary discs is quite bad, and the life of the discs is short. In addition, as the discs are worn away, the clearance between the rotary and the stationary discs is enlarged, and the particle size of the grinded material increases gradually with the result of lowering the accuracy of the grinded particles. Further, in this case, the whetstone particles worn away are mixed with the grinded material, which not only causes the contamination of the grinded material but lowers the purity of the same.

In the conventional grinder of the grinding apparatus, a rotary disc is secured to a rotary shaft arranged in the lower side of a housing and a stationary disc is mounted to a cover which is pivotally mounted to the top of the housing. Hence, in case of conducting an open or closed operation of the cover for carrying out the cleanup of the inside of the apparatus, a delicate disorder between the upper and the lower discs is liable to happen, and in order to properly perform the grinding of the material, the clearance adjustement between the two discs should be effected when the cover is opened and closed. This adjustment is troublesome and disadvantageous, and further it is quite difficult to maintain the grinding surfaces of the discs to a certain accuracy for a long time, which is a disadvantage. Further, when the grinding efficiency is lowered due to the wear and tear of the rotary and the stationary discs, the cover is disengaged and the two discs are replaced by new ones. Then, the grinding clearance between the upper and the loer discs must be adjusted again by a skilled operator, which considerably lowers the operational efficiency.

SUMMARY OF THE INVENTION

Accordingly it is an object of the present invention to provide a grinder for use in a grinding apparatus, free from the aforementioned defects and inconveniences, which is capable of reducing wear and tear of grinding discs and thus obtaining long lives of the discs, and which is easily manufactured economically.

It is another object of the present invention to provide a grinder for use in a grinding apparatus, which is capable of grinding many kinds of materials into fine particles within the predetermined range of sizes and readily obtaining a high purity of grinded material.

It is further object of the present invention to provide a grinder for use in a grinding apparatus, in which the grinder including a rotary disc and a stationary disc is formed as a cassette type so as to be replaced readily and quickly by a new one, thereby greatly increasing the operational efficiency.

It is still another object of the present invention to provide a grinder for use in a grinding apparatus, which is capable of performing a clearance adjustment between rotary and stationary discs of the grinder outside of the apparatus, in advance, and which is capable of carrying out assembling and disassembling of the grinder readily and quickly as well as the cleanup thereof.

In accordance with one aspect of the invention, there is provided a grinder for use in a grinding apparatus, comprising a pair of rotary and stationary discs facing each other, the rotary disc being adapted to be rotated through a shaft by a drive means, wherein the rotary disc has a grinding surface opposite to the stationary disc, which is provided with a large number of microbits composed of superhard grinding material particles standing close together, and wherein the stationary disc has a grinding surface opposite to that of the rotary disc, the strength of which is inferior to that of the rotary disc.

In a preferred embodiment of the present invention, the rotary disc includes a base and a surface layer on the base, and a large number of the superhard grinding material particles having heights of at most 100 micrometers are so adhered to the surface layer that the parts of the superhard grinding material particles may project at an approximately equal distance from the surface of the surface layer.

In another preferred embodiment of the present invention, the grinder further comprises a rotary shaft which is coaxially connected to the rotary disc on its base portion, a bearing holder which holds bearing means for supporting the rotary shaft and is fitted on the free end of the rotary shaft, an annular housing having an opening through which the bearing holder may pass, which retains the stationary disc on its bottom, and a ring member which supports the annular housing hanging thereon and is connected to the bearing holder on the outer side thereof, whereby the grinder is formed as a cassette type so as to be readily and quickly replaced by a new one in the apparatus.

In a further preferred embodiment of the present invention, the ring member is provided with a clearance adjusting mechanism comprising hanging-support means which support the annular housing hanging thereon and bias the annular housing to the ring member, and push means which may push the annular housing retaining the stationary disc towards the rotary disc against the biasing force of the hanging-support means.

BRIEF DESCRIPTION OF THE DRAWINGS

Other and further objects, features and advantages of the invention will appear more fully from the following description taken in connection with the preferred embodiments thereof with reference to the accompanying drawings, in which:

FIG. 1 is a fragmentary longitudinal cross sectional view of a high-speed grinder of a grinding apparatus according to the present invention;

FIG. 2 is an enlarged partial view of FIG. 1;

FIG. 6A schematically shows the condition of the grinder before the grinding, and FIG. 6B schematically shows the same after grinding;

FIGS. 7–11 show other embodiments of the grinder of the grinding apparatus according to the present invention;

DESCRIPTION OF THE PREFERRED EMBODIMENTS

Figure 3:
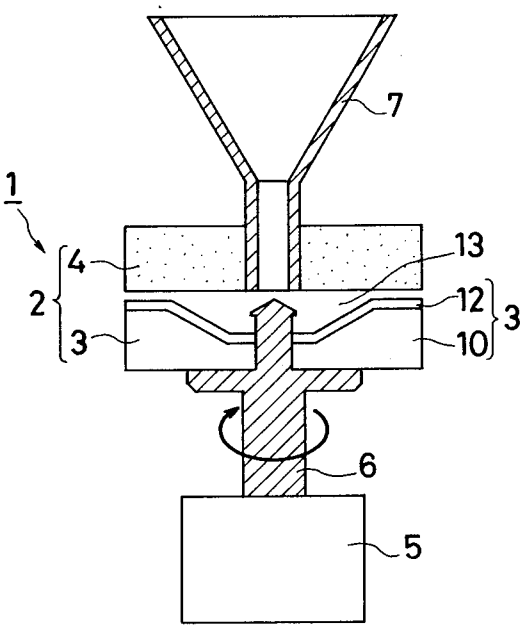
FIG. 3 is a schematic longitudinal cross sectional view of a grinding apparatus to which the grinder of FIG. 1 is applied.

Referring now to the drawings, wherein similar or corresponding components are designated by like reference numerals throughout the different figures and hence a description of the structure and function of such like components can be omitted for the sake of brevity, there is shown in FIGS. 1–3 a high-speed grinder 2 for use in a grinding apparatus 1 according to the present invention.

In the drawings, the high-speed grinder 2 comprises a pair of rotary disc 3 and stationary disc 4. The rotary disc 3 is secured to a rotary shaft 6 connected to a drive means 5 arranged in the grinding apparatus 1, and the stationary disc disposed in the opposite position to the rotary disc 3 is mounted to a hopper 7 for feeding a raw material to be grinded, as shown in FIG. 3. Although the rotary shaft 6 is coaxially arranged to the drive means 5, however, these members may be indirectly connected via a coupling belt or the like, eccentrically.

The rotary disc 3 comprises a base 10 and a surface layer 12 on the upper surface of the base 10, and a great nunber of grinding material particles 15 secured to the surface layer 12 by adhering thereto or by being partially embedded into the surface layer 12. The rotary disc 3 is formed in a cone-shape having a hollow part 13 so that a strong grinding force may occur at its slant surface by virtue of a centrifugal force while the rotary disc 3 is rotated. The grinding material particles 15 which are dispersed closely and aligned regularly, are embedded in the surface layer 12 in the form of at least one layer, preferably 4–5 layers, and the grinding material particles 15 of the outermost layer stand close together and project upwards approximately at most 40 micrometers in its height h from the surface of the surface layer 12, thereby forming microbits of an approximately equal height, which constitute a grinding surface 14 of the rotary disc 3, as shown in FIG. 2.

The grinding material particles 15 of the grinding surface 14 are composed of one or at least two kinds of superhard particles such as diamond and boron nitride, having a knoop hardness of 7000–3500 and a height of at most 100 micrometers. The particle size of the grinding particles 15 of the grinding surface 14 is relatively coarse in its central portion and relatively thin in its peripheral portion and is gradually diminished from the central portion to the peripheral portion. In general, the grinding strength of the grinding surface 14 of the rotary disc 3 is greater than that of the stationary disc 4, and as a result the grinding surface 14 is given a sharp and sufficient grinding strength. The formation of the surface layer 12 onto the base 10 can be readily effected by metal plating or the application of a synthetic resin material at the time when the grinding material particles 15 are applied to adhere the particles 15 onto the base 10.

The grinding surface 14 of the rotary disc 3 not only possesses a sharp grinding strength but also forms a screen like teeth of a comb by standing close together. Hence, the space between the teeth of the grinding particles functions as a fine screen, and therefore the grinded material particles having a size capable of passing through this space can be allowed to be passed therethrough by the centrifugal force caused by the rotation of the rotary disc, to be released outside, with the result of the equalization of the particle size of the grinded particles. The ground coarse particles incapable of passing through the space between the grinding particles still start inside the grinder and are then fine-ground in a short time to pass through that space.

The stationary disc 4 includes a grinding surface 24 on its lower side opposite to the grinding surface 14 of the rotary disc 3 and the grinding strength of the grinding surface 24 of the stationary disc 4 is inferior to that of the rotary disc 3. The grinding surface 24 of the stationary disc 4 is formed on its surface layer 22 in the same manner as the surface layer 12 of the rotary disc 3 so that a large number of superhard grinding material particles 25 adhered to or embedded in the surface layer 22 may project at an approximately equal distance in height from the surface of the surface layer 22, thereby obtaining microbits having an approximately equal height, as shown in FIG. 2.

The grinding surface 24 of the stationary disc 4 is formed in the same manner as the grinding surface 14 of the rotary disc 3 by aligning a large number of the superhard grinding material particles 25 onto a base 30 and then applying a metal plating or a synthetic resin material onto the base 30 to stick the grinding material particles thereto.

The grinding material particles 25 of the grinding surface 24 of the stationary disc 4 are made of the same materials as those of the rotary disc 3, that is, the diamond or the boron nitride corresponding to the diamond or the boron nitride used in the grinding surface 14 of the rotary disc 3. In order to maintain the clearance between the grinding surfaces of the rotary and the stationary discs 3 and 4 in the completely balanced conditions, the particle size of the grinding material particles 25 of the stationary disc 4 is relatively smaller than that of the grinding material particles 15 of the rotary disc 3.

In order to set up a clearance between the rotary disc 3 and the stationary disc 4, the rotary disc 3 is brought near to the stationary disc 4 gradually and then the rotary disc 3 is lightly contacted with the stationary disc 4. Then, what is called the dressing is conducted between the two discs and hence the clearance between the two discs is stabilized. That is, since the coarse particles of the rotary disc 3 have a relatively strong grinding force and the fine particles of the stationary disc 4 have a relatively inferior grinding force, when the two discs are contacted with each other, the grinding material particles of the rotary disc 3 are not worn away but only the grinding material particles of the stationary disc 4 are grinded unilaterally to be worn away, resulting in that the two discs get to fit each other therebetween.

In the high-speed grinder 2 above-described, the raw material to be grinded is fed in the clearance A between the opposite grinding surfaces of the two discs, and, while rotating the rotary disc 3, the material radially moving in the peripheral direction by virtue of the centrifugal force is grinded into the fine particles. The grinded fine particles are discharged from the periphery of the grinder. In this time, since the teeth-like grinding material particles 15 and 25 secured to the respective bases 10 and 30 facing each other are maintained at close proximity in the peripheral portions of the two discs, the raw material is grinded into the fine particles in a room 9 and only the fine particles grinded to the extent of being able to pass through the gaps between the teeth-like grinding material particles, can be allowed to be passed through the gaps, thereby being discharged outside from the peripheral portions of the discs. Consequently, the gaps between the teeth-like grinding material particles act as classifying means such as a sieve and a screen.

Figure 4:
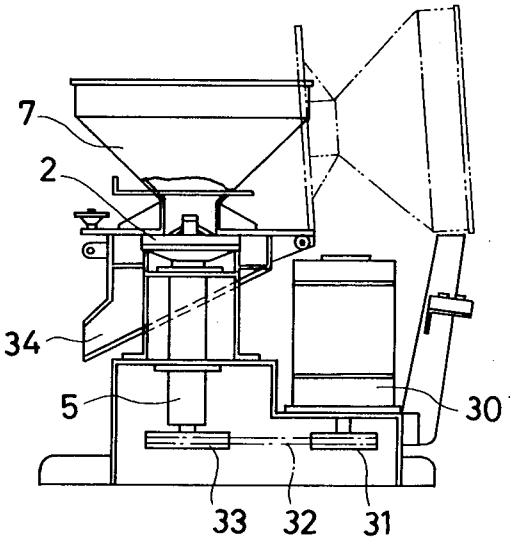
FIG. 4 is a front view of the apparatus shown in FIG. 3.

In FIG. 4, there is shown a grinding apparatus 1 including the high-speed grinder 2 above-described, a motor 30 for driving the rotary disc 3 through the shaft 5, pulleys 31 and 33 connected to the motor 30 and the shaft 5, respectively, and endless belt 32 extended between the two pulleys 31 and 33, and a discharge chute 34 from which the grinded particle material is discharged.

Then, the grinding of the relatively fine sand containing mainly silica and having a diameter of approximately at most 1.5 millimeters, which is obtained by passing the sand collected at a riverside through a 12-mesh screen, is carried out using water as a coolant and a suspension by using the grinding apparatus 1 of FIG. 4 including the high-speed grinder 2, thereby obtaining the following result. The examination is conducted by the light transmission method.

| | |
|---|---|
| 44–20 micrometers | 17.2% |
| 20–10 micrometers | 16.5% |
| 10–4 micrometers | 12.3% |
| 4–2 micrometers | 11.1% |
| at most 2 micrometers | 42.9% |

The clearance between the two discs is measured as follows:

| | |
|---|---|
| Projection of grinding particles | 30–40 micrometers + |
| Deflection of discs' rotation | 5–15 micrometers |

-continued

| | |
|---|---|
| Clearance of two discs | 35–55 micrometers |

The specifications are in the followings:

(1) Diameters of the two discs are both 24 cm (2) As to the rotary disc

The form of the surface is flat. The grinding material is diamond and the diamond particle of the same particle size of #100 or 149 micrometers is embedded in the entire grinding surface of the disc. The projection of the grinding material particles from the surface of the surface layer is 30–40 micrometers. For sticking the grinding material particles embedded in the surface layer, nickel is used. The power of the electric motor for driving the disc is 3.7 Kw. The rotation speed is 3200–3400 r.p.m.

(3) As to the stationary disc

The concave type stationary disc. The grinding material is alundum and its particle size is #100. The pores are filled up by impregnating a synthetic resin material. The height of the "room" is 3 mm in a peripheral portion of a circle with the radius of 3.75 mm.

(4) As to the raw material

The raw material consists of sand and water and their ratio is one to four by weight.

(5) Disposal speed of the raw material

Approximately 30 kg/hour.

Figure 5:
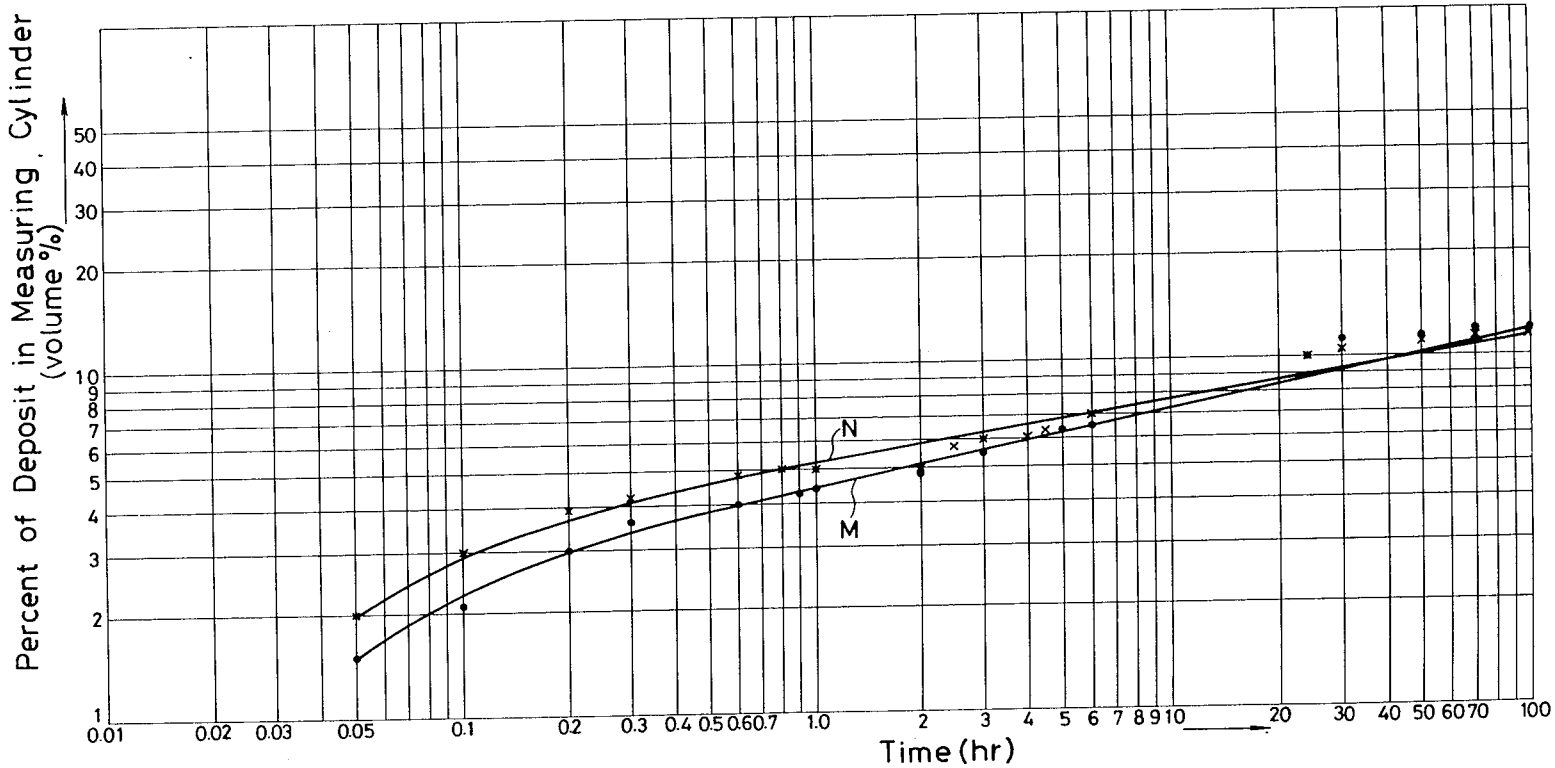
FIG. 5 is a graph showing a proportion change with the passage of time with reference to the deposit in a messcylinder, which is obtained by a sedimentation test using the grinded material grinded by the apparatus of FIG. 4.

In accordance with the above examination data, no oversized ground particle over 44 micrometers is obtained. FIG. 5 is a log-log graph showing a volume percent change of a deposit in a measuring cylinder with the passage of time, which is obtained by a sedimentation test using the obtained ground material. In FIG. 5, a line M is obtained by using the ground material which is repeatedly ground four times by the high-speed grinder 2 of the apparatus 1, and a line N is obtained by using the material which is ground only one time by the grinder. In this case, for example, 2% of the deposit means, in its turn, that the colloidal floating substance and the transparent liquid portion seen in the uppermost portion of the measuring cylinder occupy 98%. As is apparent from FIG. 5, generally, the deposited amount of the material ground four times is larger than that of the material ground one time, but its difference is slight. Therefore, it is readily unerdrstood that the raw material can be ground into extremely fine particles even one time grinding by the high-speed grinder according to the present invention and hence this grinder is superior in its grinding capacity.

Next, the roughly grinded trunk shucks of chickens are grinded in the presence of a coolant by using the high-speed grinder 2 in the same manner as above, in which the diameters of the two discs are both 18 cm and the clearance between the two discs is 0.05 mm, and in which the particles of the grinding surface are 20 mesh, and the rotating speed of the rotary disc is 1500–1800 r.p.m., thereby obtaining a slurry composed of a mixture of meat protein paste and bone powder of at most 10 micrometers, which is dispersed therein. Then, before and after this grinding, the wearing conditions of the rotary and the stationary discs are checked, that is, the thicknesses $s_1$ and $s_2$ of the rotary disc before and after the grinding and the thicknesses $t_1$ and $t_2$ of the stationary disc before and after the grinding are measured, thereby obtaining the results of $s_1-s_2=0$ and $t_1-t_2=0$, as shown in FIGS. 6A and 6B.

Although the examples of the grinding of the riverside sand and the trunk shucks of chickens using the high-speed grinder 2 have been described hereinbefore, however, of course, other various kinds of materials, for example, foods, fuels, paints, medicines, drugs, inorganic material such as various ores, metals and ceramics, organic materials such as vegetables, animals, coal, oil residue and various high polymer solids of carbohydrates, electronic materials, microorganisms, etc., may be grinded by using the high-speed grinder of the present invention.

Figure 7:
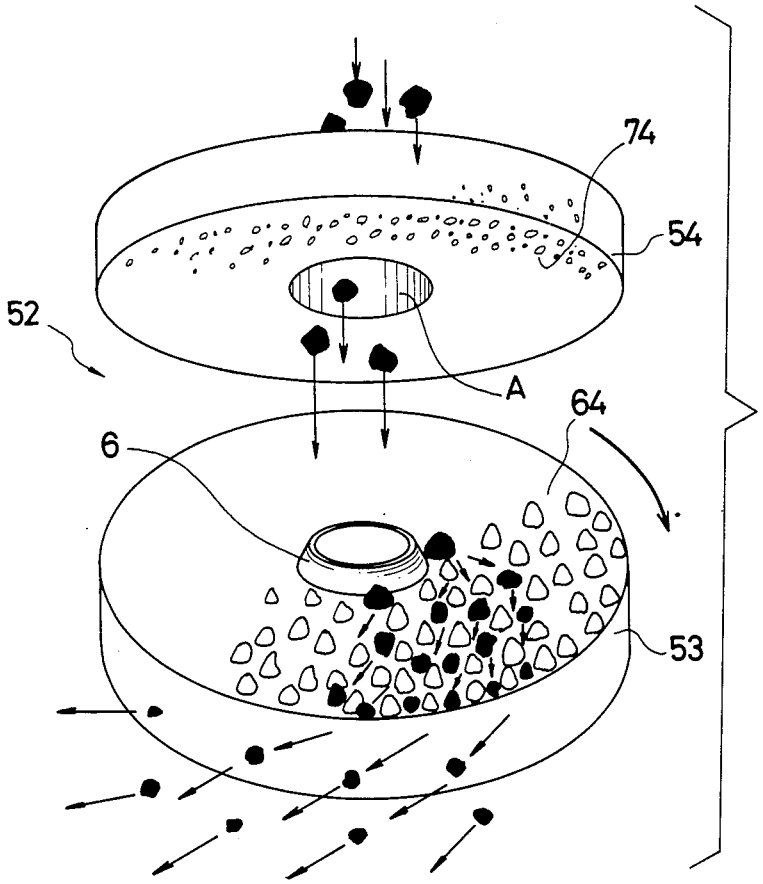

In FIGS. 7 and 8, there is shown another grinder 52 according to the present invention, in which a rotary disc 53 has a flat grinding surface 64. The form of the grinding surface of the stationary disc depends on the nature of the material to be ground, and in this case in which the grinding surface 64 of the rotary disc 53 is formed flat, a grinding surface 74 of a stationary disc 54 is preferably formed to somewhat concave-form. This type grinder can be used for grinding a relatively easily grindable material.

Although the grinding material particles are embedded over the entire grinding surface of the rotary disc in the above described embodiments, the grinding material particles may be omitted in the central portion of the grinding surface of the rotary disc. Further, although in the aforementioned embodiments, the grinding surface is formed by embedding the grinding material particles in the surface layer of the stationary disc, however, the whole stationary disc may be formed by a material having a relatively low hardness such as a brown alumina grinding material (A), a white alumina grinding material (WA), a black silundum grinding material (C) and a green silundum grinding material (GC). In this case, the hardness of the stationary disc is preferably approximate $\frac{2}{3}$ of that of the grinding material particles of the rotary disc.

Further, when the material to be grinded is relatively hard or the ground particles are partial such as flat and spindle-shaped and thus more highly grinding is required, a pair of rotary disc 83 and stationary disc 84 shown in FIG. 9 are preferably used. In this embodiment, the material to be grinded is pushed to the stationary disc 84 by virture of a centrifugal force caused by the high-speed rotation of the rotary disc 83, thereby properly grinding the material.

Further, in FIG. 10, there is shown further embodiment of a pair of rotary disc 93 and stationary disc 94, which may be effectively used as well.

As shown in FIGS. 11A and 11B, a plurality of layers of grinding material particles 115 are embedded in a surface layer 112 of a rotary disc 103 so that the outermost layer may constitute the microbits, and a plurality of layers of grinding material particles 125 are embedded in a surface layer 122 of a stationary disc 104 in a similar manner to the rotary disc 103. In this case, when the outermost layer of the grinding particles 115 or 125 are worn away, the next outermost layer may be utilized by conducting a truing or a dressing, which is advantageous.

Figure 12:
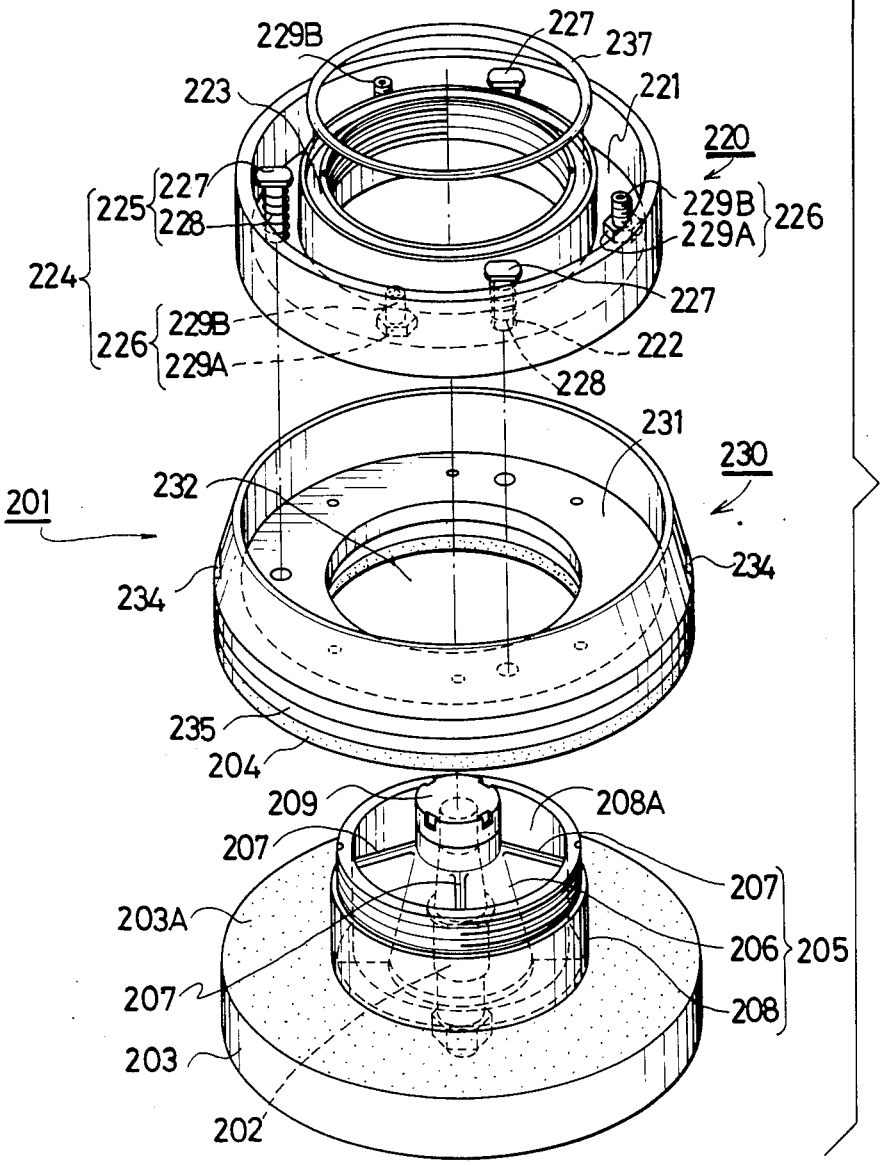
FIG. 12 is an exploded perspective view of another embodiment of a grinder of a grinding apparatus according to the present invention.
Figure 13:
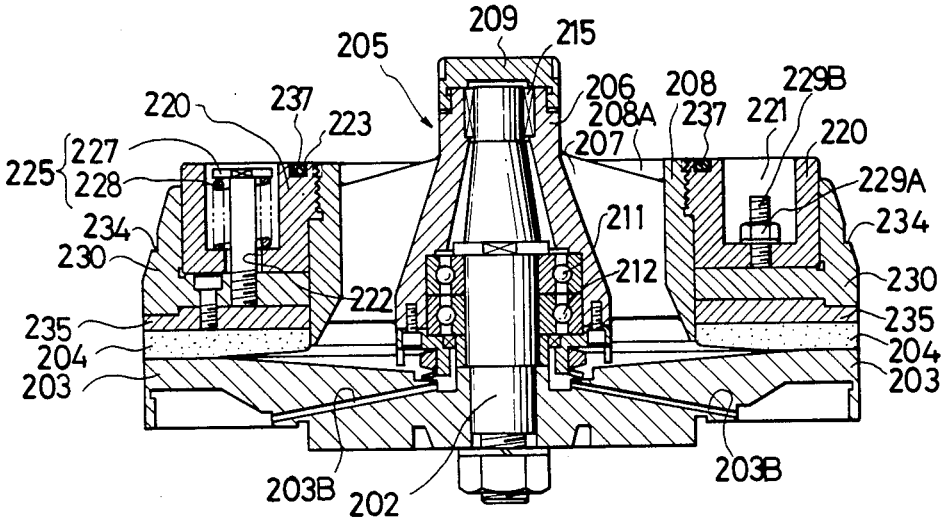
FIG. 13 is a longitudinal cross sectional view of the grinder assembled of FIG. 12.
Figure 14A:
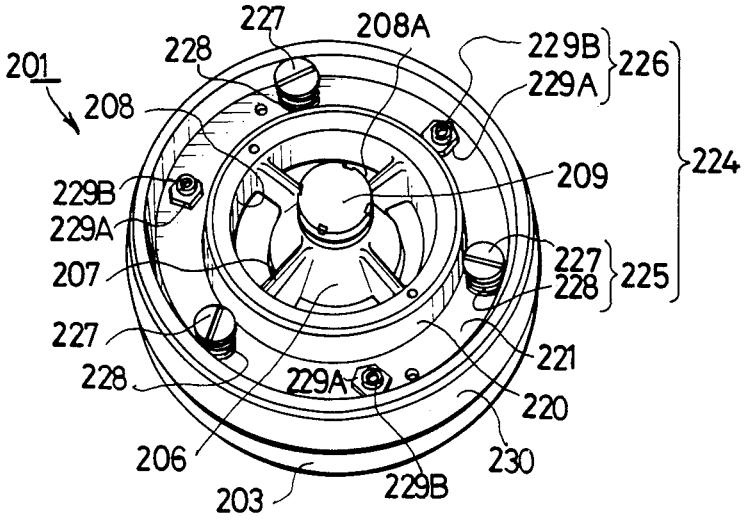
FIG. 14A is a perspective view, seen from the upper side, of FIG. 13.
Figure 14B:
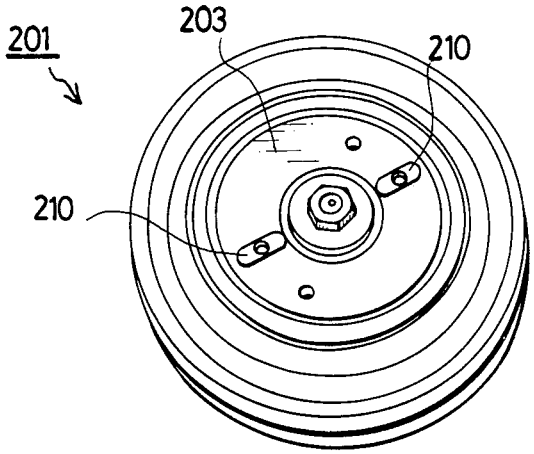
FIG. 14B is a perspective view, seen from the bottom side, of the same.

In FIGS. 12–14, there is shown still another embodiment of a grinder 201 for use in a grinding apparatus according to the present invention. The grinder 201 comprises a rotary shaft 202, a rotary disc 203 coaxially connected to the base portion of the shaft 202, having a grinding surface 203A on its top, and a stationary disc 204 opposite to the grinding surface 203A of the rotary disc 203. This grinding surface 203A is formed by electrodepositing diamond fine particles onto the top surface of the rotary disc 203, thereby coating as a diamond electrodeposition layer thereto. The stationary disc 204 which is an annular grinder to be contacted with the grinding surface 203A so as to be dressed, is arranged over the rotary disc 203. The rotary disc 203 is so connected to the shaft 202 that the axis of the shaft 202 may be perpendicular to the grinding surface 203A of the rotary disc 203 in order to remove a deflection of the grinding surface 203A while rotating the rotary disc 203.

On the free top end portion of the shaft 202 is fitted a bearing holder 205 holding a couple of ball bearings 211 and 212 and a needle bearing 215 in its lower and upper inner parts for supporting the shaft 202. The bearing holder 205 comprises a dome-formed bearing holding portion 206, four arms 207 radially extending from the bearing holding portion 206, and a tubular portion 208 connected to the bearing holding portion 206 via the four arms 207. Between the adjacent arms 207 of the bearing holder 205 there are opening spaces as passages 208A through which the grinded materials may pass. The tubular portion 208 of the bearing holder 205 is provided with a threaded portion in its upper outer periphery, with which a threaded portion formed in an upper inner periphery of a ring 220 hereinafter described in detail is engaged. The top of the bearing holding portion 206 of the bearing holder 205 is covered by a cap 209 fitted thereon.

An annular housing 230 is arranged over the rotary disc 203, and the housing 230 holds the stationary disc 204 on its bottom through an annular holding disc 235 mounted to the bottom of the housing 230. The housing 230 is also provided with a hollow portion 231 for receiving the ring 220 and has a circular opening 232 in its central portion so that the tubular portion 208 of the bearing holder 205 may pass through the openings of the stationary disc 204, the annular holding disc 235 and the annular housing 230, as shown in FIG. 13. The ring 220 for supporting the housing 230 hanging thereon is contained in the hollow portion 231 of the housing 230.

The ring 220 is engaged with the outer periphery of the tubular portion 208 of the bearing holder 205, and thereby the ring 220 is integrally connected to the bearing holder 205. The ring 220 is provided with an annular groove 223 in its top portion, in which an annular rubber packing 237 is inserted. The ring 220 is also provided with a mechanism 224 for adjusting a clearance between the grinding surface 203A of the rotary disc 203 and the stationary disc 204.

The clearance adjusting mechanism 224 comprises hanging-support means 225 for supporting the housing 230 hanging thereon and biasing the housing towards the ring 220, and push means 226 for pushing the annular housing 230 retaining the stationary disc 204 towards the rotary disc 203 against the biasing force of the hanging-support means 225. In the hollow portion 221 of the ring 220, three hanging-support means 225 and three push means 226 are alternately arranged at an equal interval.

The hanging-support means 225 comprises a guide pin 227 having a male screw in its lower end, which passes through an opening 222 formed in the hollow portion 221 of the ring 220 and the male screw of which is engaged with a female opening formed in the housing 230, and a compressed coil spring 228 rounded around the guide pin 227, which biases the housing 230 towards the ring 220. The housing 230 is supported by the hanging-support means 225 hanging thereon by approximately equal forces thereof.

The push means 226 comprises a nut member 229A secured to the ring 220 coaxially with another opening formed approximately between the two openings 222 of the ring 220, and a screwed push pin 229B which is engaged with the nut member 229A so that the push pin 229B may pass downwards through the another opening of the ring 220 so as to push the housing 230 towards the rotary disc 203. Therefore, the stationary disc 204 mounted to the bottom of the housing 230 through the holding disc 235 may be pushed towards the rotary disc 203 by the push means 226 against the biasing forces of the hanging-support means 225.

By imparting approximately equal forces downwards to a pair of cutouts 234 formed in left and right opposite sides of the outer periphery of the housing 230, from the outside, the stationary disc 204 mounted to the housing 230 is pushed down towards the rotary disc 203 in order to able to supplementarily adjust the clearance between the rotary disc 203 and the stationary disc 204, which is widened by the wear and tear.

In FIGS. 15–23, there is shown a grinding apparatus 251 including the grinder 201 formed as a cassette type, described above. The apparatus 251 comprises a mounting base 252 installed on a floor F, a housing 253 secured onto the base 252, a rotary shaft 254 arranged upright within the housing 253, a cover 263 for covering the free end face of the housing 253, and the cassette type of the grinder 201 received in the housing 253. The shaft 254 is driven by a driving motor 255 arranged outside the housing 253, and the rotation of the shaft 254 is transmitted to the rotary disc 203 of the grinder 201, thereby performing the grinding of the material. The shaft 254 is connected via pulleys 257 and 258 mounted to a motor shaft 256 of the motor 255 and the shaft 254, respectively, and a V-shaped belt 259 extended between the two pulleys 257 and 258, to the motor 255.

Outside of the housing 253 of the grinder 251, a cover 261 having a discharge chute 260 from which the grinded material is discharged, is disposed, or the grinded material is discharged outside through a space 260A defined by the housing 253 and the cover 260, and the discharge chute 261 of the cover 260.

Figure 16:
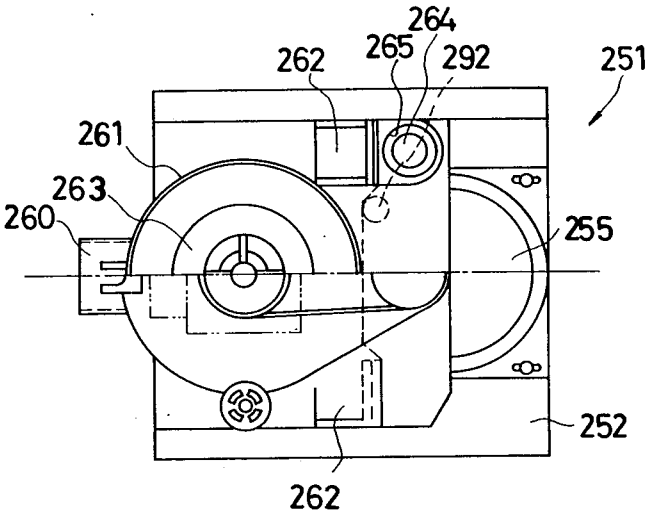
FIG. 16 is a schematic top plan view of the lower half of FIG. 15.
Figure 15:
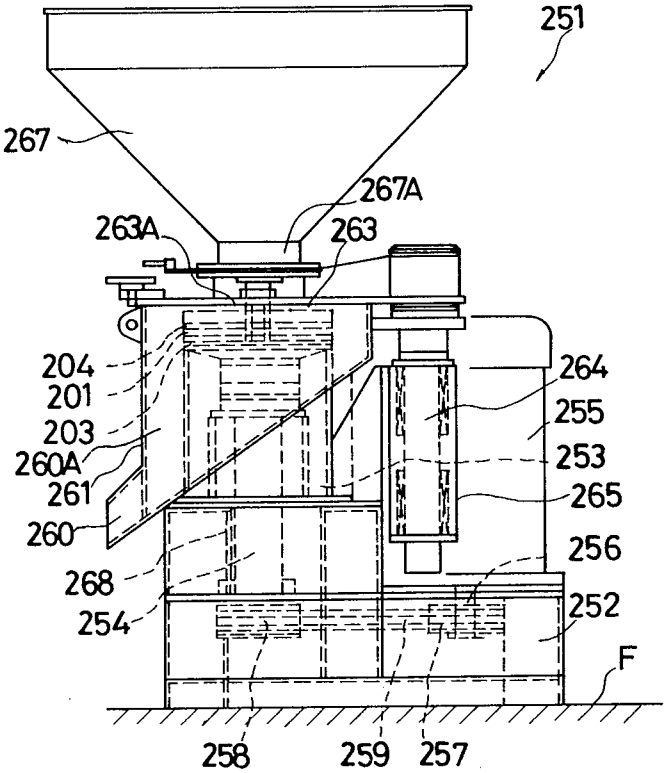
FIG. 15 is a front view of a grinding apparatus including the grinder of FIG. 12.
Figure 17:
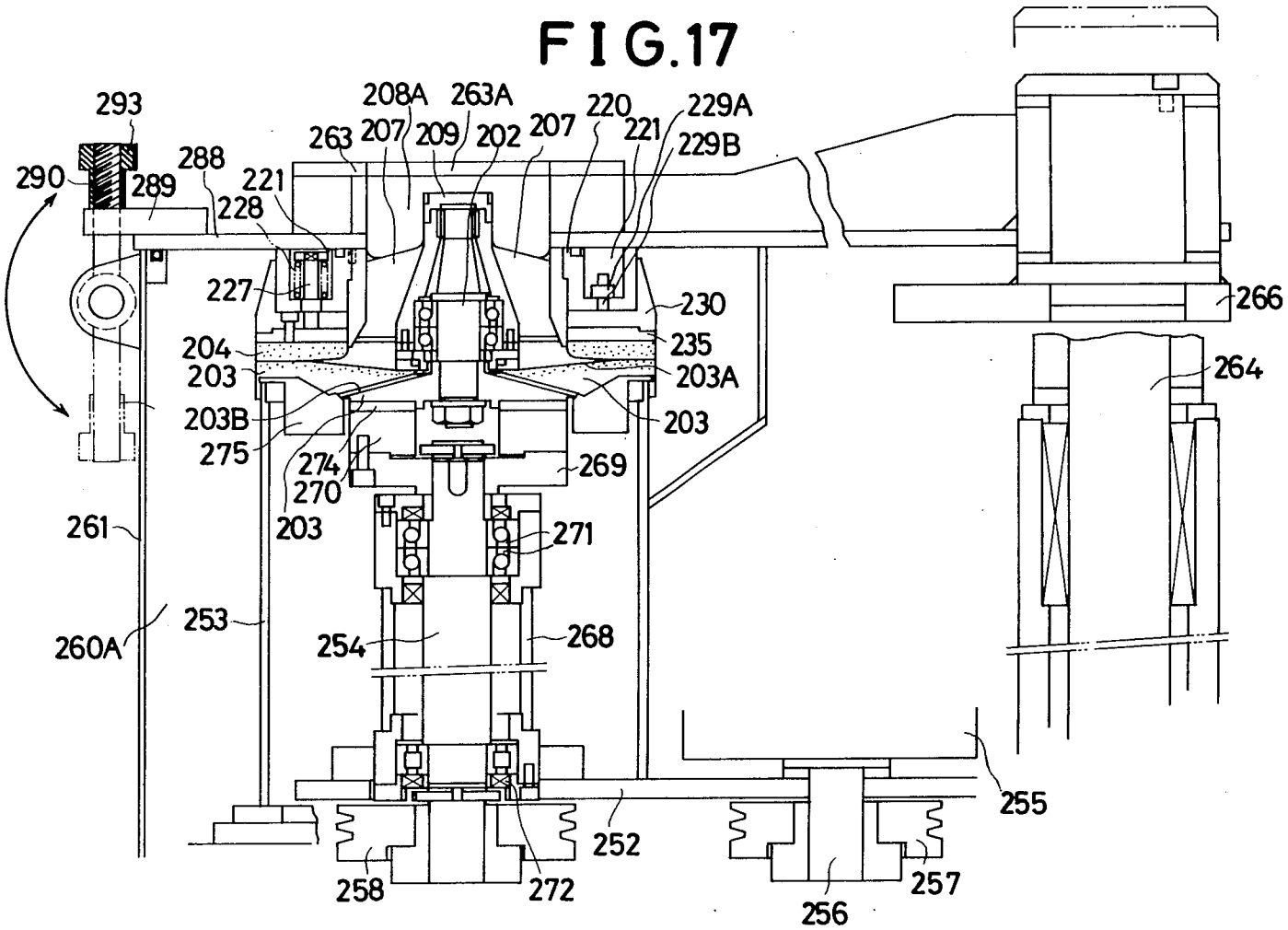
FIG. 17 is an enlarged fragmentary front view of the apparatus shown in FIG. 15.
Figure 18:
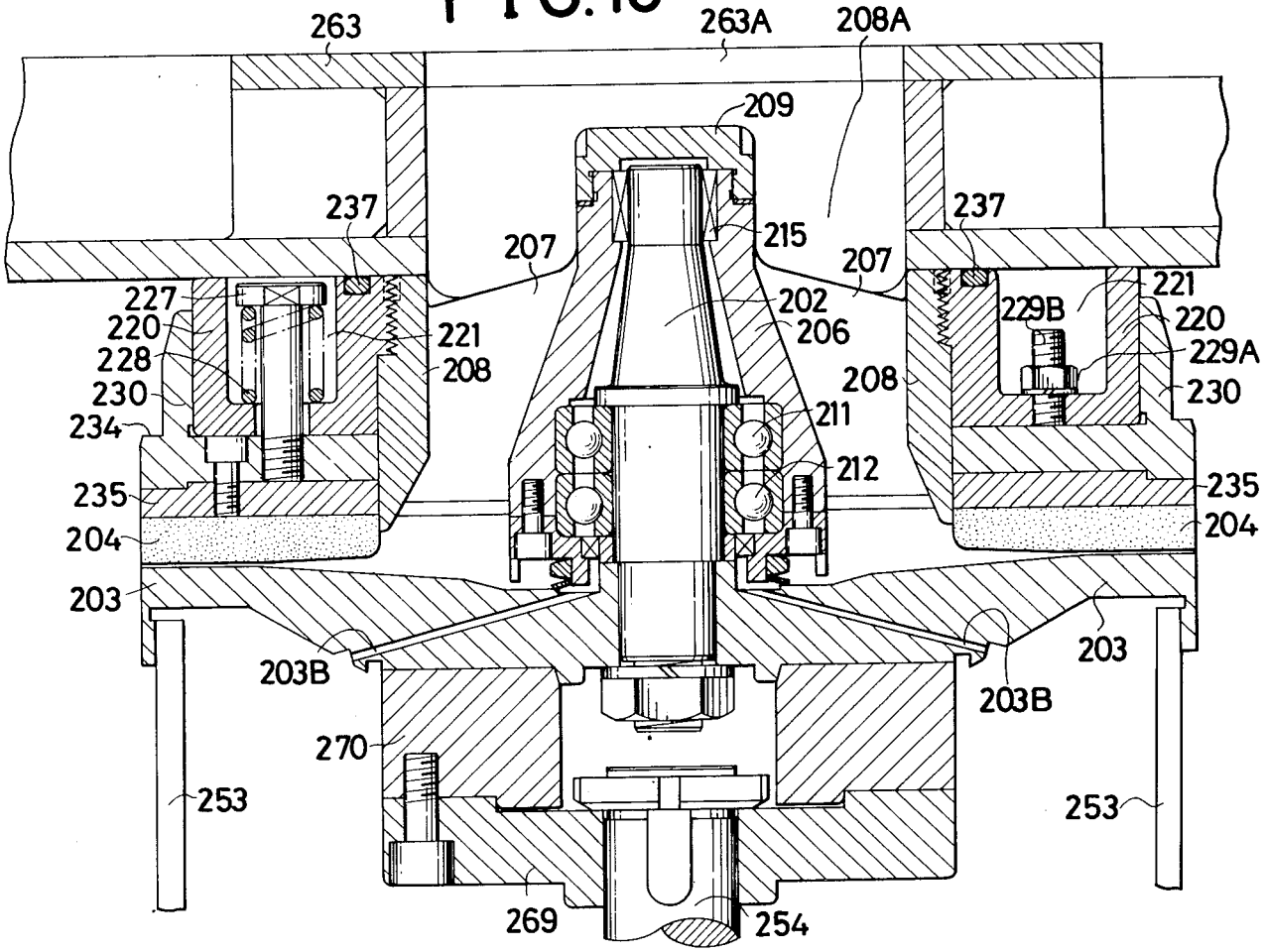
FIG. 18 is an enlarged longitudinal cross sectional view of the grinder part of the apparatus of FIG. 17.
Figure 19:
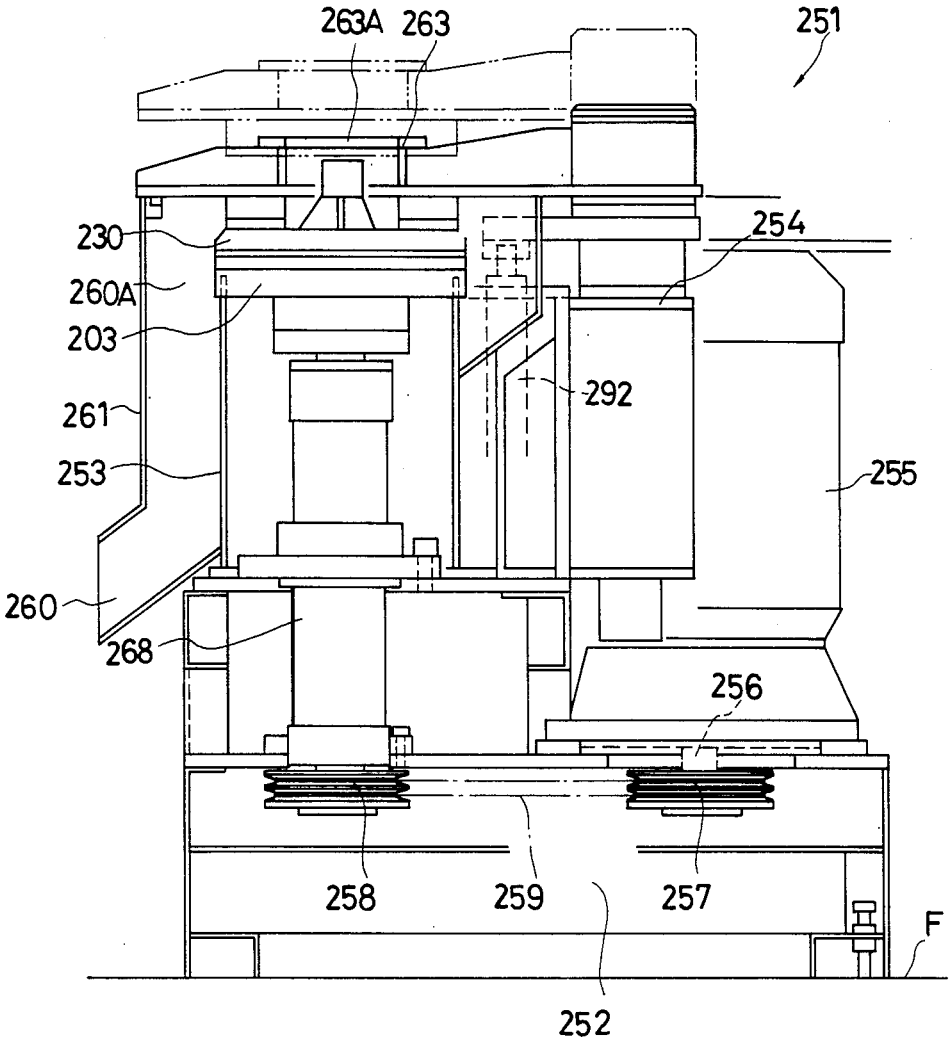
FIG. 19 is an enlarged front view of the apparatus of FIG. 15, showing inside thereof.
Figure 20:
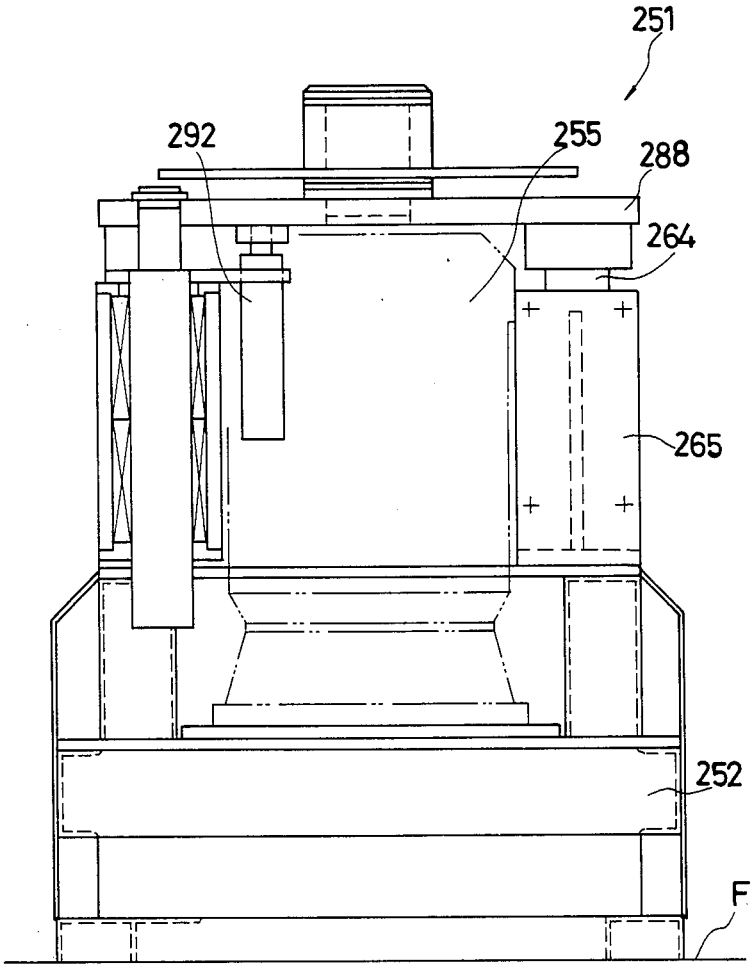
FIG. 20 is an enlarged side view of FIG. 19.

A pair of leg bodies 262 are secured to the base 252 outside of the cover 261, as clearly shown in FIG. 16. A cylindrical body 265 for guiding a support pillar 264 when the cover body 263 is moved up and down, is secured to the leg body 262, and the two pillars 264 are coupled by a connecting plate 266. The base portion of the cover body 263 is pivotally mounted to the center of the connecting plate 266 so as to be pivoted in the horizontal plane, as shown in FIG. 17. Accordingly, as the connecting plate 266 is moved up and down by a jack 292 via a rod thereof, the pillars 264 are simultaneously moved up and down, and, when the cover body 263 is pivoted in the horizontal plane apart from the grinder 201, the upper side of the apparatus 251 is released to the atmosphere.

Figure 21:
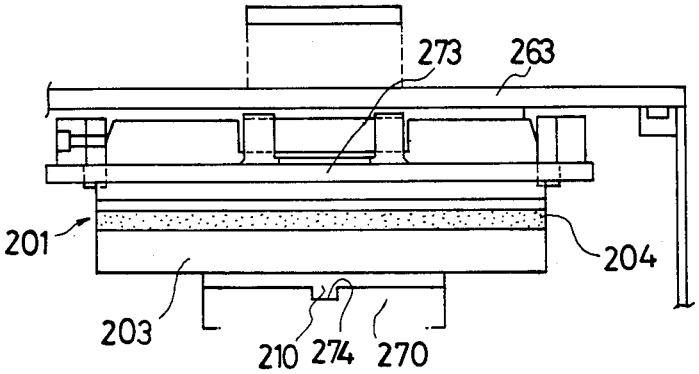
FIG. 21 is a schematic longitudinal cross sectional view of a clutch part of the apparatus shown in FIG. 15.
Figure 22:
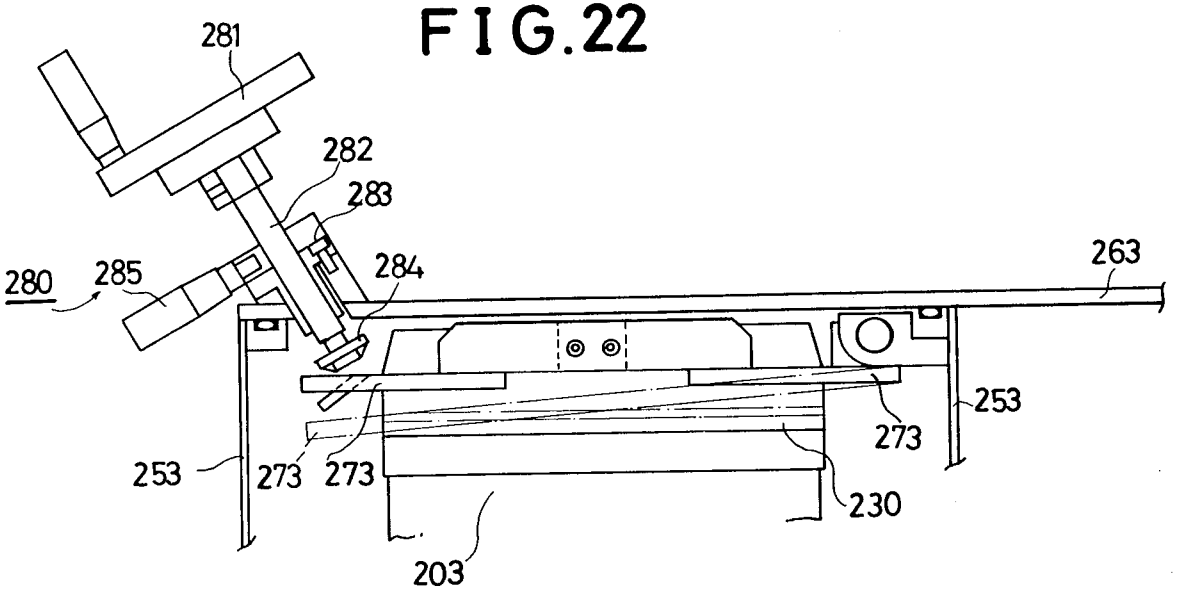
FIG. 22 is a schematic front view of fine adjusting means of the apparatus of FIG. 15.
Figure 23:
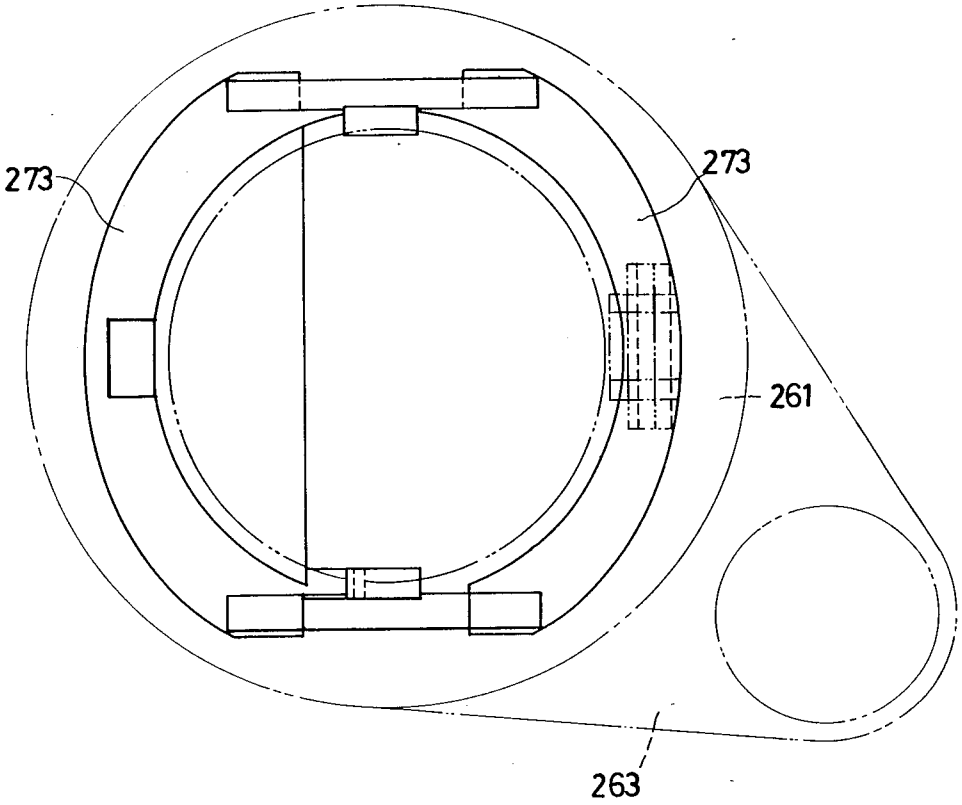
FIG. 23 is an elevational view of a frame body disposed to a housing of the apparatus of FIG. 15.

Inside the housing 253 of the apparatus 251, a cylinder 268 is disposed for holding bearings 271 and 272 for supporting the shaft 254 on its upper and lower portions, and for surrounding the shaft 254. In the upper side of the cylinder 268, a coupling 269 connected to the shaft 254, and a clutch 270 having key ways 274 in its upper surface, connected to the coupling 269 are arranged. A pair of keys 210 mounted to the bottom of the rotary disc 203 are engaged with the key ways 274 of the clutch 270, as shown in FIG. 21, to mount the cassette type of the grinder 201 onto the clutch 270, with the result that the rotation of the shaft 254 may be transmitted to the rotary disc 203. Further, as shown in FIGS. 21–23, a frame member 273 for stopping the upward movement of the grinder 201 is pivotally mounted to the inner upper end of the housing 253 so that the frame member 273 may pivot in the horizontal plane to engage with the cutouts 234 of the annular housing 230 of the grinder 201. A conduit 275 for discharging the water dropping from water weep holes 203B provided in the lower side of the rotary disc 203 is disposed outside the clutch 270, as shown in FIG. 17.

The cover body 263 is provided with an inlet 263A in its about central portion, and the lower outlet 267A of a hopper 267 is positioned right over the inlet 263A of the cover body 263. The hopper 267 is moved up and down along with the cover body 263 by means of the jack 292. A fine adjusting means 280 for adjusting the clearance between the rotary disc 203 and the stationary disc 204 is disposed to the cover body 263, as shown in FIG. 22. The front end of the fine adjusting means 280 abuts on the frame member 273 engaged with the cutouts 234 of the housing 230 of the grinder 201.

The fine adjusting means 280 comprise a fine adjusting screw rod 282 having a handle 281 in its one end, which is engaged with a female screw part 283 fixed to the cover body 263, and an abut portion 284 mounted to the other end of the screw rod 282, which abuts on the frame member 273. The female screw part 283 possesses a stop screw 285 for stopping the screw rod 282 in the desired set condition. Hence, by turning the handle 281, the screw rod 282 together with the abut portion 284 is moved forward to push the frame member 273 by the abut portion 284, thereby pushing down the housing 230 along with the stationary disc 204 towards the rotary disc 203.

A fork member 289 is mounted to the front end of a base plate 288 secured to the cover body 263. A screw rod 290 for fixing the cover body 263 to the cover 261 is pivotally mounted to the outer upper end portion of the cover 261. The screw rod 290 is pivoted upwards into the concave portion of the fork member 289, and a clamping screw 293 engaged on the screw rod 290 is tightened, thereby fixing the cover body 263 onto the cover 261. In this condition, the rubber packing 237 fitted in the groove 223 of the ring 220 of the grinder 201 is pressed in contact with the lower surface of the cover body 263, and hence the engagement of the key ways 274 of the clutch 270 with the keys 210 of the rotary disc 203 is more ensured.

Then, before the grinder 201 is set up to the grinding apparatus 251, the stationary disc 204 is pushed down towards the rotary disc 203 by rotating the push pins 229B, to adjust the clearance between the rotary disc 203 and the stationary disc 204, in advance. Thus the clearance adjusted grinder 201 of the cassette type is set to the grinding apparatus 251. Then, the material to be grinded is fed to the hopper 267 from its inlet 267A, and the material then drops onto the rotary disc 203 rotating within the housing 253 through the inlet 263A of the cover body 263. Next, the material is radially moved outwards on the grinding surface 203A of the diamond electrodeposition layer, formed over the rotary disc 203 and is finally grinded into the fine particles between the grinding surface 203A of the rotary disc 203 and the stationary disc 204, and thereby the ground fine particles are scattered outwards from the periphery of the discs. The scattered particles are struck against the inner wall of the cover 261 and are then discharged outside from the discharge chute 260. In this time, the waste water is discharged outside passing through the water weep holes 203B of the rotary disc 203 and then the conduit 275.

When the dressing of the stationary disc 204 moves forward as the grinding is repeatedly carried out, the stop screw 285 is loosened and the handle 281 of the fine adjusting means 280 is rotated so as to push down the frame member 273, resulting in that the housing 230 of the grinder 201 is pushed down against the biasing forces of the coil springs 228 of the hanging-support means 225. Accordingly, the widened clearance between the rotary disc 203 and the stationary disc 204 is readily adjusted to be narrowed.

When the clearance adjustment comes near critical, the cassette type of the grinder 201 will be replaced by new one in the apparatus 251 as follows. That is, the clampling screw 293 positioned in the front end of the cover body 263 is loosened and the screw rod 290 is released from the fork member 289. Then, the cover body 263 along with the hopper 267 are lifted by actuating the jack 292, and thereafter the cover body 263 and the hopper 267 are pivoted sideways in the horizontal plane, with the result of releasing of the top end of the housing 253 in the apparatus 251. Further, the frame member 273 is pushed up. Now, the cassette type of the grinder 201 may readily be removed from the clutch 270, and a new grinder 201 is set up to the clutch 270. Then, the operation is conducted in the reverse order to the aforementioned operation to be ready to start the grinding.

Figure 24:
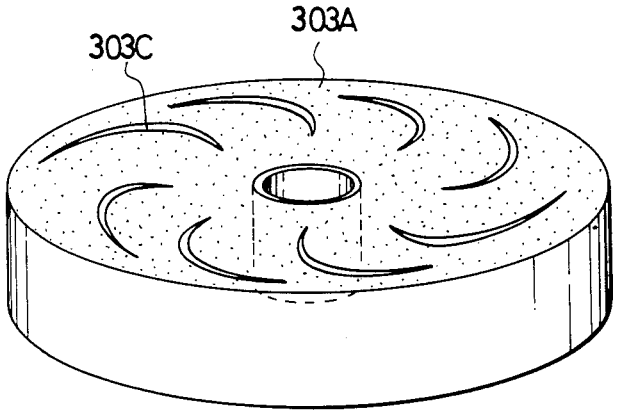
FIG. 24 is a perspective view of another embodimemt of a rotary disc used in the grinder according to the present invention.

In FIG. 24, there is shown another embodiment of a rotary disc having a different grinding surface from that of the rotary disc 203 aforementioned. In this case, a plurality of spiral grooves 303C are formed on a grinding surface 303A. A plurality of radial grooves may be formed on the grinding surface of the rotary disc.

It is readily understood from the above description, according to the present invention, since the grinded particles are discharged outside through screens formed by the grinding material particles of the rotary disc, practically no oversized grinded particles are obtained and the desired particle sizes of the fine grinded particles are readily obtained. Further, the clearance between the rotary disc and the stationary disc can be maintained stably and thus the cause of the over grinding can be effectively prevented.

In addition, since the raw material is grinded by using the superhard microbits, the obtained particles are not mashed and hence the product particles are formed in the regular form as well as the cutting surfaces of the particles are smooth. Consequently, the load during the grinding operation is light and the working efficiency per unit time is very high.

Further, according to the present invention, since the grinding material of the discs is superhard and thus the wear and tear of the discs is less, less powder of the grinding material admixes with the grinded material, and the high purity of the grinded material can be readily obtained. The heat generated in the tips of the microbits is effectively transmitted or spread outside as well as cooled by a coolant and hence the grinded material may not affected by the heat at all.

According to the present invention, the wear and tear of the grinding surfaces of the discs is quite small to obtain long lives of the discs, and accordingly the frequencys of the clearance adjustements and the replacement of the discs as well as the repair and correction of the forms of the discs are largely improved, with the result of high operational efficacy.

Further, in accordance with the present invention, when the clearance between the rotary and the stationary discs are widened and the clearance adjustment comes near critical, the grinder can be readily and quickly replaced by a new one, thereby promoting the operational efficiency of the grinding.

In the present apparatus, since the rotary disc is secured to the rotary shaft of a short length perpendicular to the axis of the shaft, the deflection of the grinding surface of the rotary disc rotating is effectively removed. Hence, when the grinding operation is conducted for a long time, the particle size of the grinding particles can be exactly within the predetermined range.

According to the present invention, the assembling and the disassembling of the grinder and the cleanup of the grinder can be carried out readily and quickly.

Although the present invention has been described in its preferred embodiments, it is readily understood that various changes and modifications may be made without departing from the spirit and scope of the present invention.

What is claimed is:

1. A grinder for use in a grinding apparatus, comprising:

a rotary disc rotated through a shaft by drive means and formed with a grinding surface and a stationary disc formed with a grinding surface;

said grinding surfaces of said discs facing each other with a small clearance being constantly defined therebetween;

the grinding surface of said rotary disc including microbits for cutting a material to be treated, said microbits being formed of superhard grinding particles arranged close together on said grinding surface of said rotary disc; and the grinding surface of said rotary disc being formed to have a grinding strength which is larger than that of the grinding surface of said stationary disc, to exhibit cutting force larger than that of said grinding surface of said stationary disc.

2. A grinder as defined in claim 1, wherein the rotary disc includes a base and a surface layer on the base, and wherein the superhard grinding particles have heights of at most 100 micrometers and are adhered to the surface layer in such manner that the parts of the superhard grinding particles project at an approximately equal distance from the surface of the surface layer.

3. A grinder as defined in claim 2, wherein the parts of the superhard grinding particles project at a distance of at most 40 micrometers from the surface of the surface layer of the rotary disc.

4. A grinder as defined in claim 2 or 3, wherein the superhard grinding particles are embedded in the surface layer in the form of a plurality of layers.

5. A grinder as defined in claim 2 or 3, wherein the superhard grinding particles have a knoop hardness ranging 3500–7000.

6. A grinder as defined in claim 1, wherein the rotary disc is formed in a cone-shape having a hollow part.

7. A grinder for use in a grinding apparatus, comprising a rotary disc and a stationary disc each formed with a grinding surface, the grinding surfaces of said discs facing each other, the rotary disc being adapted to be rotated through a shaft by drive means, the grinding surface of said rotary disc being formed of microbits composed of superhard grinding material particles arranged close together, and the grinding surface of said stationary disc having a strength which is less than that of the grinding surface of said rotary disc, wherein the grinder further comprises a rotary shaft which is coaxially connected to the rotary disc on its base portion, a bearing holder which holds bearing means for supporting the rotary shaft and is fitted on the free end of the rotary shaft, an annular housing having an opening through which the bearing holder passes and which holds the stationary disc at the bottom thereof, and a ring member which supports the annular housing hanging thereon and is connected to the peripheral portion of the bearing holder, whereby the grinder is formed as a cassette so as to be readily and quickly replaceable by another grinder of the same construction.

8. A grinder as defined in claim 7, wherein the ring member includes a mechanism for adjusting a clearance between the rotary disc and the stationary disc, the mechanism comprising hanging-support means which support the annular housing hanging thereon and bias the annular housing towards the ring member, and push means for pushing the annular housing holding the stationary disc towards the rotary disc against the biasing force of the hanging-support means.

9. A grinder as defined in claim 8, wherein at least two hanging support means and at least two push means are alternatively arranged in an annular hollow portion of the ring member in the circumferential direction thereof.

10. A grinder as defined in claim 9, wherein the hanging-support means comprise a guide pin including a screw portion and passing through an opening formed in the annular hollow portion of the ring member, the screw portion of the guide pin engaging with a screw portion formed in the annular housing, and a coil spring fitted on the guide pin for biasing the annular housing towards the ring member.

11. A grinder as defined in claim 9, wherein the push means comprise a nut member secured to the ring member coaxially with an opening formed in the ring member, and a screw push pin which is engaged with the nut member so that the screw push pin may pass through the opening of the ring member so as to push the housing towards the rotary disc.

12. A grinder as defined in claim 7, wherein the bearing holder comprises a dome-formed bearing holding portion, arm members radially extending from the bearing holding portion, and a tubular portion connected to the bearing holding portion via the arm members, the tubular portion including a threaded portion which engages with a threaded portion formed in the ring member.

* * * * *